US007373751B1

(12) United States Patent
Schaffer

(10) Patent No.: US 7,373,751 B1
(45) Date of Patent: May 20, 2008

(54) SPRING-LOADED FIREARM MAGAZINE

(76) Inventor: Douglas R. Schaffer, 5811 Zaring Dr., West Chester, OH (US) 45069

( * ) Notice: Subject to any disclaimer, the term of this patent is extended or adjusted under 35 U.S.C. 154(b) by 258 days.

(21) Appl. No.: 11/014,918

(22) Filed: Dec. 17, 2004

(51) Int. Cl.
*F41A 9/25* (2006.01)

(52) U.S. Cl. ..... 42/50; 42/7; 89/33.1

(58) Field of Classification Search ..... 42/50, 42/7; 89/33.1
See application file for complete search history.

(56) References Cited

U.S. PATENT DOCUMENTS 2,712,705 A * 7/1955 St. Amant ..... 42/50
3,020,662 A * 2/1962 Merkel ..... 42/11
3,205,604 A * 9/1965 Plumer ..... 42/50
3,235,994 A * 2/1966 Grippo ..... 42/50
5,056,252 A * 10/1991 Velezis ..... 42/50
5,353,537 A * 10/1994 Mercenier ..... 42/7
5,388,362 A * 2/1995 Melcher ..... 42/70.02
5,664,355 A * 9/1997 Ronkainen ..... 42/18

* cited by examiner

*Primary Examiner*—Stephen M Johnson
(74) *Attorney, Agent, or Firm*—Joseph T. Leone, Esq.; DeWitt Ross & Stevens S.C.

(57) ABSTRACT

A quick-release magazine for use with firearms is provided, the magazine comprising a conventional firearm magazine and a spring, the spring comprising a center plate with two fins projecting outwardly from the plate. The spring is positioned between the floor plate and base pad of the magazine, with the center plate of the spring aligning with the magazine and the fins projecting outwardly from the plate. When the magazine of the present invention is inserted into a firearm, the fins are compressed between the magazine and the gun. The compressed fins provide a forceful ejection from the firearm when the magazine must be replaced.

7 Claims, 6 Drawing Sheets

SPRING-LOADED FIREARM MAGAZINE

FIELD OF THE INVENTION

The invention is directed to firearm magazines, and more particularly to a quick-release firearm magazine for use in competition shooting events, hunting, and law enforcement and military applications.

BACKGROUND OF THE INVENTION

Firearms, including pistols, rifles and shotguns, are used in a variety of sporting competitions around the country wherein various skills of the competitor are matched against both another opponent and the clock. Similarly, firearms are a staple piece of equipment for hunters, law enforcement and military personnel, worldwide. Key to success in competition, in the field, and on the battlefield is the ability to handle and fire a firearm quickly and skillfully. Thus, the number of rounds of ammunition any particular weapon can fire before it needs to be reloaded is of significant interest. Further, in certain competitive events, as well as in law enforcement and military applications, the ability to reload a weapon quickly and accurately is a prized quality.

Weapon designers constantly strive to decrease the time needed to reload a firearm. It is axiomatic that a competitor (or soldier) who spends less time reloading his weapon will have an advantage over a similarly situated competitor (or enemy soldier) who spends more time reloading his weapon. With regard to military and law enforcement applications, the advantages of a quick-release magazine are obvious. The faster an empty magazine can be released and a fully-loaded magazine inserted into the weapon, the faster a soldier or police officer can protect himself or another.

In many types of automatic, semi-automatic, bolt-action, and lever-action firearms (e.g., pistols, rifles, shotguns, and the like), several rounds of ammunition (anywhere from two to several hundred or more) are stored in a spring-loaded magazine. While the physical dimensions of magazines differ among manufacturers, models and calibers, all firearm magazines share certain critical features. Notably, all magazines include a housing in which the rounds are stored and held until needed. The housing includes an open top which is dimensioned and configured to feed the rounds of ammunition smoothly into the receiver of the corresponding firearm. The outer dimensions of the housing are configured to matingly and releasably engage a corresponding magazine bay and magazine locking/releasing mechanism of a corresponding firearm. Disposed inside the housing, and anchored at the bottom of the magazine, is spring that is biased to urge the rounds of ammunition toward the top of the magazine. In this fashion, as the top-most round in the magazine is extracted and fired (by the action of the firearm), a new round is urged into the top-most position and is ready to be loaded into the receiver of the firearm. Small-capacity magazines for most pistols and center-fire rifles are roughly rectangular in appearance, while large-capacity magazines are normally curved to save space. Certain types of long guns, such as many rimfire .22 caliber rifles, use tubular magazines that feed the rounds axially, rather than transversely. As used herein, the term "magazine" encompasses all such magazines, without limitation.

In pistols and certain types of carbines (short-barreled rifles), the magazine bay is located in the pistol grip of the firearm. In most hunting long guns, the magazine bay is located forward of the trigger assembly, in or near the "forearm" area of the weapon. In certain tactical military weapons, the magazine is located behind the trigger assembly in the butt of the weapon. (This type of firearm is often called a "bullpup," a design that yields a very compact weapon.) Firearms with a tubular magazine can have the magazine disposed within either the butt of the weapon or in the forearm of the weapon.

The Colt model M1911 pistol and its magazine are a perfect example of a typical semi-automatic pistol design. The model M1911 pistol remains a very popular and widely copied semi-automatic pistol. This storied pistol was designed by John M. Browning and was the standard-issue sidearm for U.S. military forces from 1911 until 1985 (hence the designation "M" for military and the first year of its mass production). The Colt M1911 was originally chambered in .45 ACP. The design proved an instant success. Roughly 2.7 million M1911s were produced by the close of World War I. In the period between the world wars, the design was modified slightly and the modified version was given the model designation 1911A1. During this period, more than 20 different manufacturers, worldwide, were licensed to produce this model, in a wide range of different calibers. U.S. manufacturers, including Colt, Remington, Ithaca, Union Switch and Signal, and The Singer Sewing Machine Company, combined to produce more than 2 million model 1911A1 pistols in the war years 1941 to 1945. The 1911 design, long since "off-patent", has been widely copied and modified.

The magazine for a 1911-style pistol features a roughly rectangular housing with walls that narrow in width at the top. The bottom of the housing is open and terminates in an outwardly-directed lip or flange. A floor plate is attached to the flange at the lower end of the housing, thereby closing off the bottom end of the magazine. A butt pad or "slam pad" is also attached to the flange at the lower end of the housing, and serves to cushion the lower end of the housing when the magazine is forcefully inserted into the firearm (which is often the case). A leaf spring is disposed within the lower end of the housing to urge the rounds loaded within the magazine toward the top. When the magazine is empty, a release button on the pistol is pressed, and the magazine is grasped at its lower end by the user's free hand and separated from the weapon.

The prior art is replete with efforts to decrease the time needed for reloading. The most simple route, of course, is to increase the capacity of the magazine (while conforming to the law and the standards of any given competition). Many countries, however, place strict limits on magazine capacities for firearms sold into the civilian markets. After-market, large-capacity magazines are widely available in the United States. But a larger magazine also significantly increases the weight of the weapon when the magazine is fully loaded. The added weight of additional rounds compromises the speed of handling the weapon and the added weight can also compromise the accuracy of the weapon. Large capacity magazines also tend to misfeed more often than smaller capacity magazines. Thus, a larger capacity is not an ideal solution to minimizing the time needed to reload a firearm.

SUMMARY OF THE INVENTION

This invention, which is defined by the claims set forth at the end of this document, is directed to a quick-release magazine used to increase the speed of reloading a weapon. A basic understanding of some of the preferred features of the invention can be attained from a review of the following brief summary of the invention, with more details being provided in the Detailed Description.

A basic exemplary version of the present invention provides a magazine with a spring-assisted release mechanism that provides an automatic, smooth, predictable, and fast release from a weapon. The spring-assisted release mechanism is affixed to the magazine itself and not to the firearm. In a preferred version, the magazine of the present invention is physically ejected from the weapon by a spring disposed at the lower end of the magazine. When the magazine is inserted into the weapon, the spring is biased against the frame or handle of the weapon, thus providing a motive force to eject the magazine when the release button on the weapon is activated. When empty, the magazine may be released from the weapon by pressing the magazine release button on the weapon, allowing the user to eject the empty magazine with a single hand, without any need to grasp the magazine. This frees the user's hand to reach for a fully-loaded magazine to insert into the now-empty weapon. In this fashion, an empty magazine is quickly, smoothly, efficiently, forcefully, and predictably released from the weapon, allowing a fully-loaded magazine to be inserted in the weapon in a prompt manner.

The quick-release magazine is dimensioned and configured to matingly and releasably engage a firearm through a spring which (in the preferred embodiment) is positioned between the floor plate and base pad of the magazine. In other embodiments of the invention, the spring is affixed to the magazine at a point adjacent to where the magazine protrudes from the firearm. In a preferred version, the spring includes a center plate with two fins projecting outwardly from the plate and from the walls of the magazine housing. When the spring is positioned in the magazine, the center plate of the spring aligns with the magazine and the fins project outwardly from the plate. When the magazine is inserted into a weapon, the fins protrude sufficiently far from the magazine housing such that they will not fit within the magazine bay. As a consequence, when the magazine is ultimately seated within the firearm, the projecting fins are biased between the magazine and the frame or handle of the weapon and act as leaf springs. The compressed fins provide a counterforce that powerfully ejects the magazine from the firearm when the magazine release button on the firearm is activated.

The quick-release magazine of the present invention conforms with the dimensional requirements of competitive shooting and can be used with any firearm configuration that uses a removable magazine to feed ammunition into the firearm, including handguns, rifles and shotguns of any type of action (e.g., automatic, semi-automatic, bolt-action, pump-action, lever-action, and the like). The magazine of the present invention can be used for competition purposes, military and law enforcement purposes, as well as hunting and recreational purposes. The magazine of the present invention is easy to manufacture, using common materials such as spring steel. Further, the magazine may be dimensioned and configured for use with any type of ammunition, including single-projectile rounds (e.g. bullets or tranquilizer darts), or multiple-projectile rounds (e.g., shotgun shells, rubber pellet rounds used for crowd control in riot situations, and the like). Additionally, the magazine can be dimensioned and configured to accommodate ammunition of any size, gauge, or caliber.

The description set out above is merely of an exemplary preferred version of the invention. Numerous additions and modifications may be made. These examples should not be construed as describing the only possible versions of the invention, and the true scope of the invention will be defined more fully from the following detailed description and the attached claims.

DETAILED DESCRIPTION OF THE INVENTION

Figure 1:
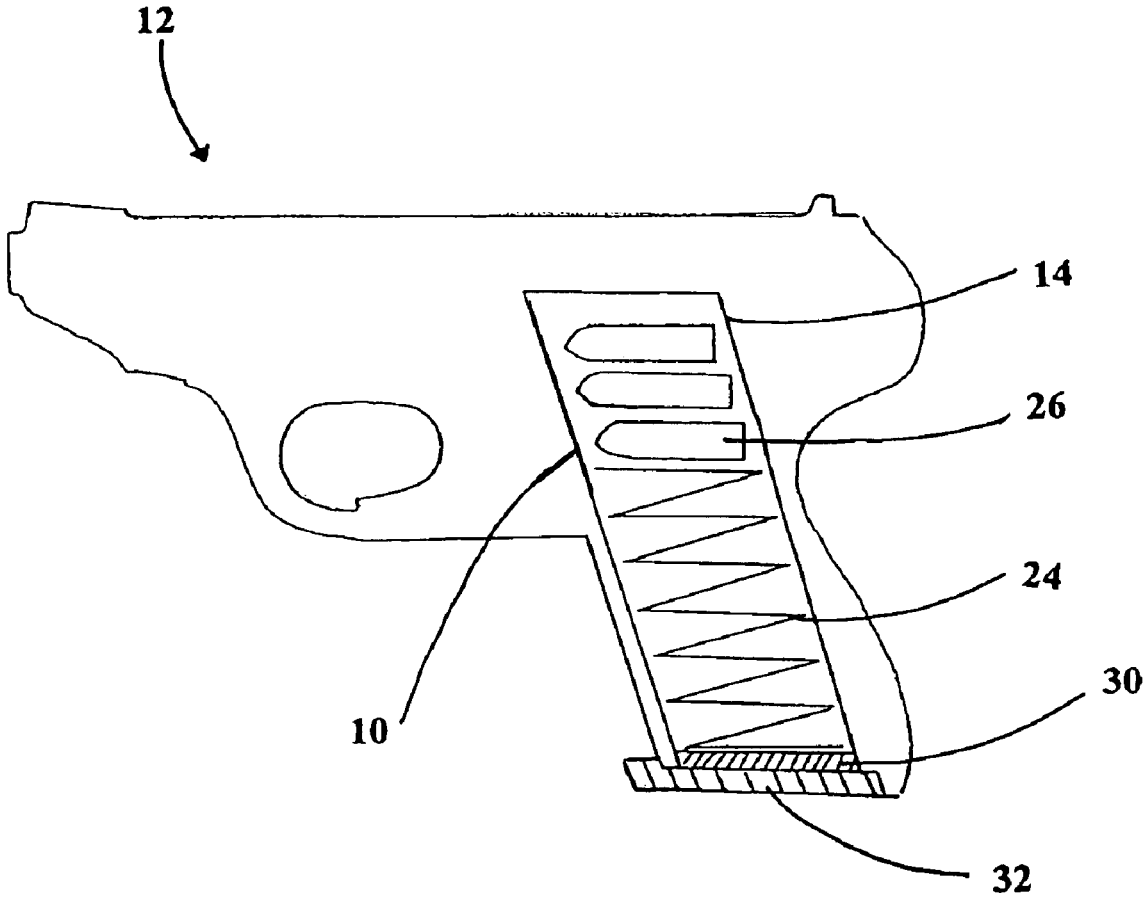
FIG. 1 shows a front elevation cross-sectional view of a weapon (a pistol) 12 with a magazine 10 inserted.

Referring now to the figures, where the same reference numerals are used across all of the figures to designate identical or similar features, a typical firearm magazine 10, as may be commonly used in a weapon 12, is shown. FIG. 1 shows a magazine 10 inserted within a handgun 12. The magazine 10 comprises a housing 14 with two narrow side walls 16 and 20 (see FIG. 3) and two broad side walls 18 and 22 (see FIG. 3). The housing 14 stores a feeder spring 24 for feeding ammunition 26 into the weapon 12. The nature of the ammunition 26 is not critical to the invention. Each round of ammunition 26 may comprise bullets and corresponding cartridges, shotgun shells, darts, etc. The housing 14 terminates at its lower end in a floor plate 30 and a conventional base pad or "slam pad" 32. The base pad 32 is used in conjunction with the magazine 10 to provide a smooth end to the magazine 10 and to cushion the magazine when it is forcefully inserted into the firearm.

Figure 2:
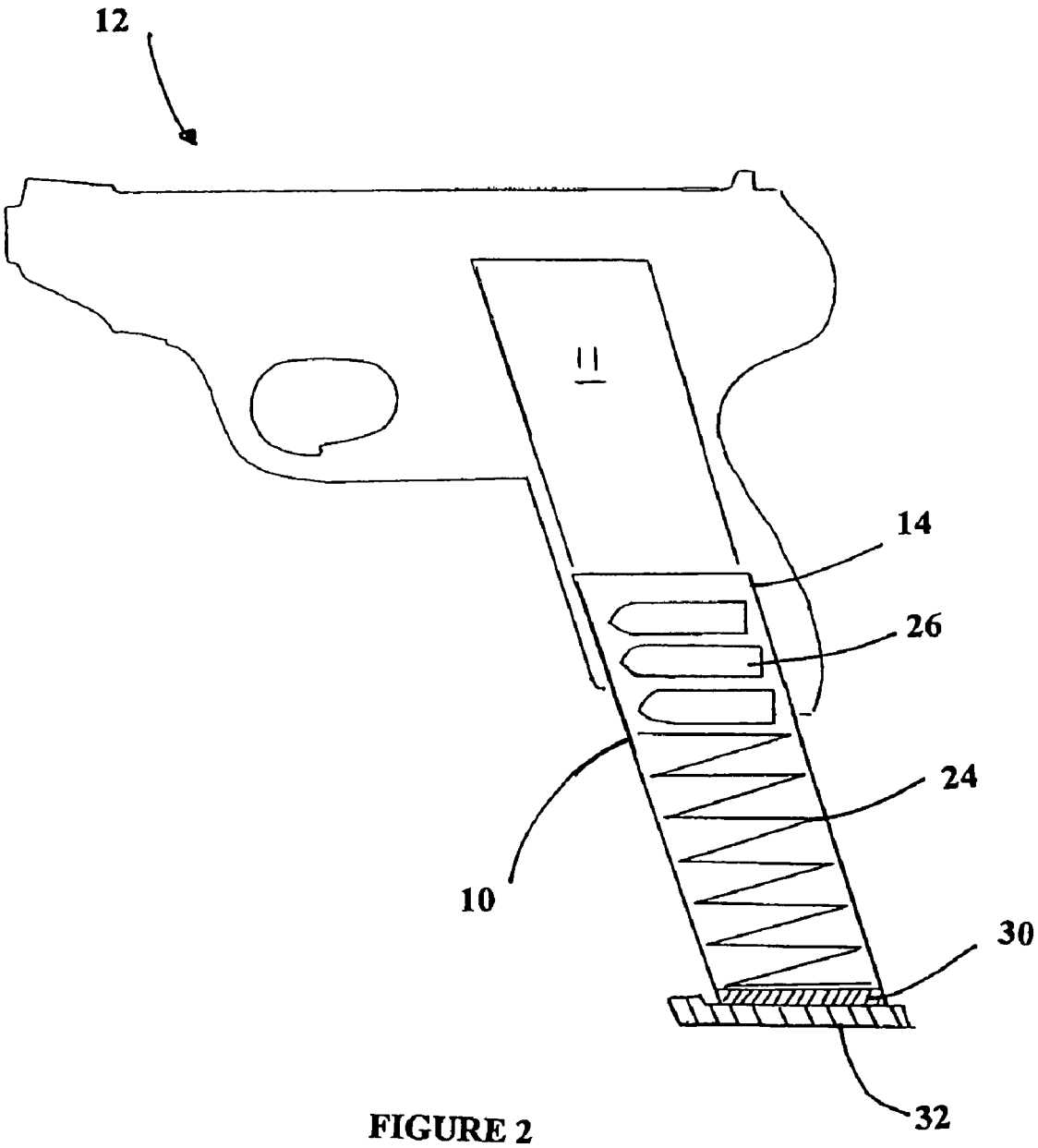
FIG. 2 shows a front elevation cross-sectional view of the quick-release magazine 10 partially inserted into the weapon 12.

FIG. 2 illustrates the magazine 10 as it is being removed (or inserted) into the weapon 12 and also illustrates the corresponding magazine bay 11 in the weapon. The magazine 10, containing ammunition 26 and feeder spring 24, is inserted into the weapon 12 via a complementary magazine bay 11. The details of the magazine bay itself are not critical to the operation of the present invention. Each type of magazine-fed firearm includes a magazine bay whose internal dimensions complement the external dimensions of a corresponding magazine.

Figure 3:
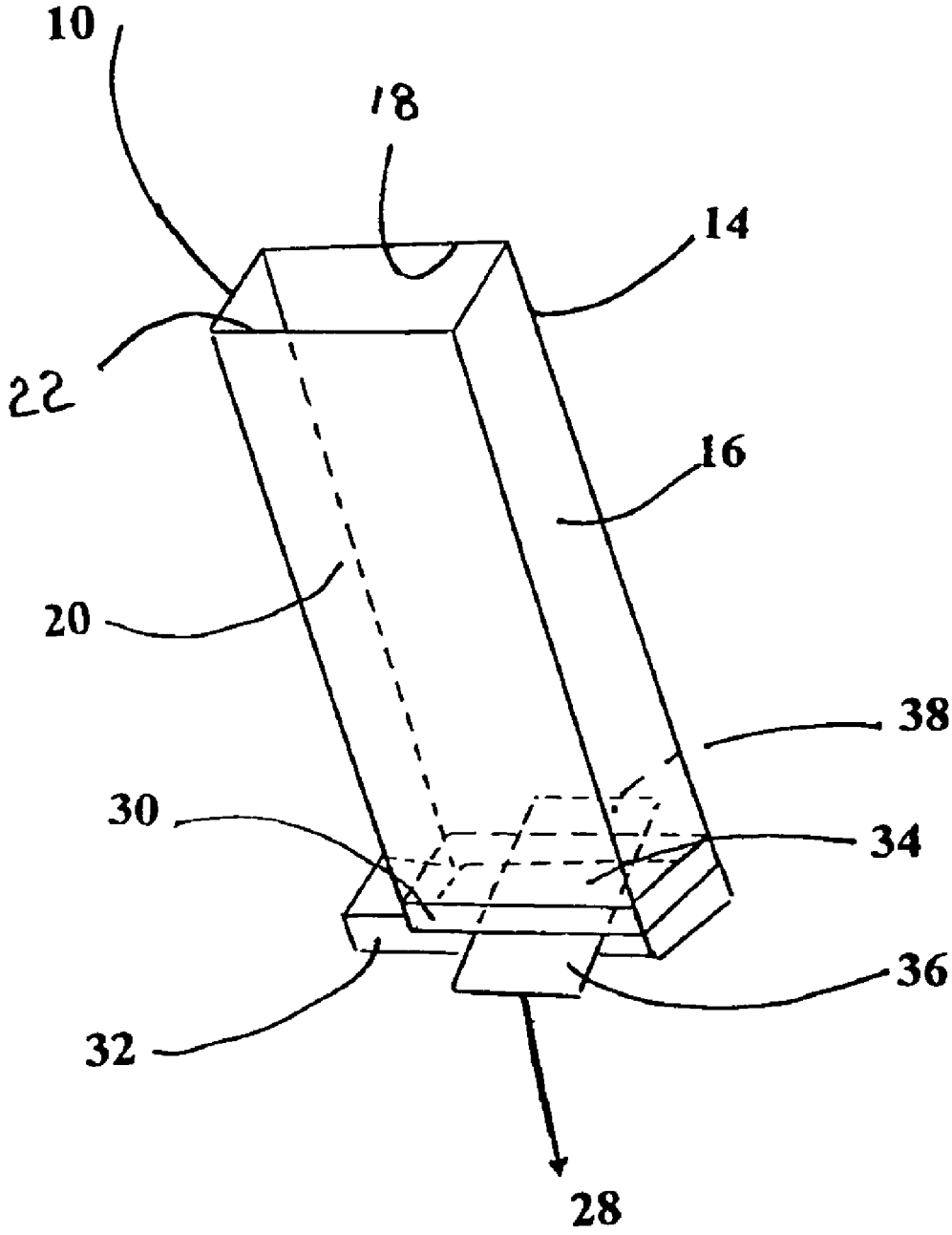
FIG. 3 is a perspective rendering showing the magazine 10 with spring 28 extending therefrom. The spring is comprised of fins 36 and 38 projecting outwardly from a center plate 34.

FIG. 3 illustrates a magazine 10 having the spring clip 28 of the present invention inserted between the floor plate 30 and the base pad 32 of the magazine 10. In the preferred embodiment of the invention, the spring clip 28 comprises a leaf spring. As shown in FIG. 3, the spring clip 28 comprises a center plate 34 with two narrow fins 36 and 38 extending outwardly from the plate 34. The center plate 34 is dimensioned and configured to correspond to the walls 16, 18, 20 and 22 of the housing 14. However, the narrow fins 36 and 38 extend outwardly from the plate 34, extending beyond the broad walls 18 and 22 of the housing 14. Thus, when the magazine 10 is not inserted into a weapon 12, the narrow fins 36 and 38 of the spring clip 28 extend outwardly beyond the dimensions of the walls 18 and 22. In contrast, when the magazine 10 containing the spring clip 28 is inserted into a weapon 12, the narrow fins 36 and 38 are compressed between the frame or handle of the weapon 12 and the walls 18 and 22 of the magazine 10.

Figure 4:
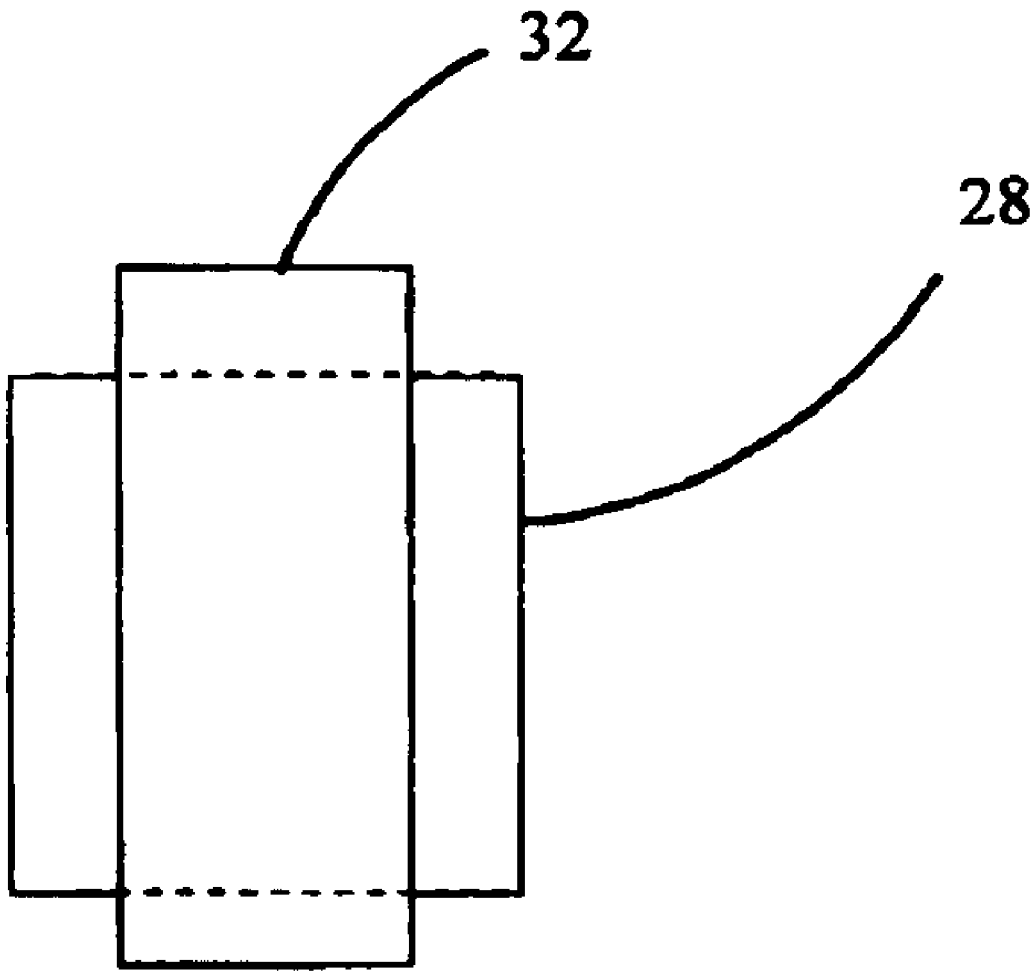
FIG. 4 is a bottom plan view of the magazine 10 illustrating the spring 28 and the base pad of the present invention.

FIG. 4 is a bottom plan view of the magazine showing the spring 28 extending beyond the edges of the base pad or slam pad 32. In the invention, the spring must be dimensioned to be slightly larger than the width of the magazine itself so that when the magazine is inserted, the protruding ends of the spring 28 will be biased against the handle or frame of the firearm.

Figure 5:
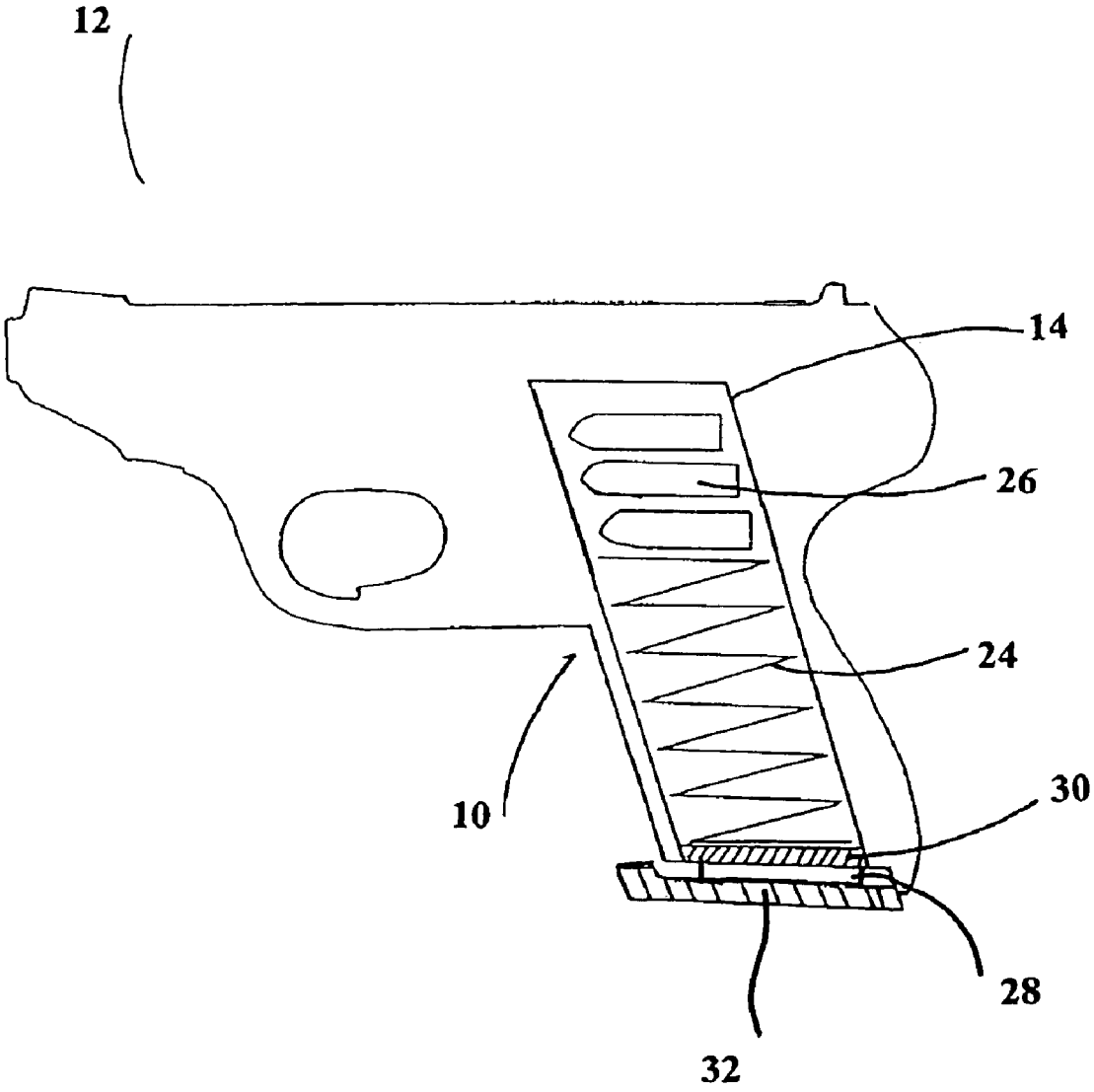
FIG. 5 is a front elevation cross-sectional view of a conventional handgun 12 with the quick-release magazine 10 inserted into the handgun.

FIG. 5 shows the quick-release magazine 10 fully inserted into a weapon 12 such as a handgun. When the spring clip 28 of the present invention is inserted into a magazine 10, the narrow fins 36 and 38 are compressed between the frame or handle of the weapon 12 and the broad walls 18 and 22 of the housing 14. The compressed fins 36 and 38 provide a motive force for the rapid ejection of the magazine 10 when the magazine release button (not shown) on the weapon 12 is activated.

Figure 6:
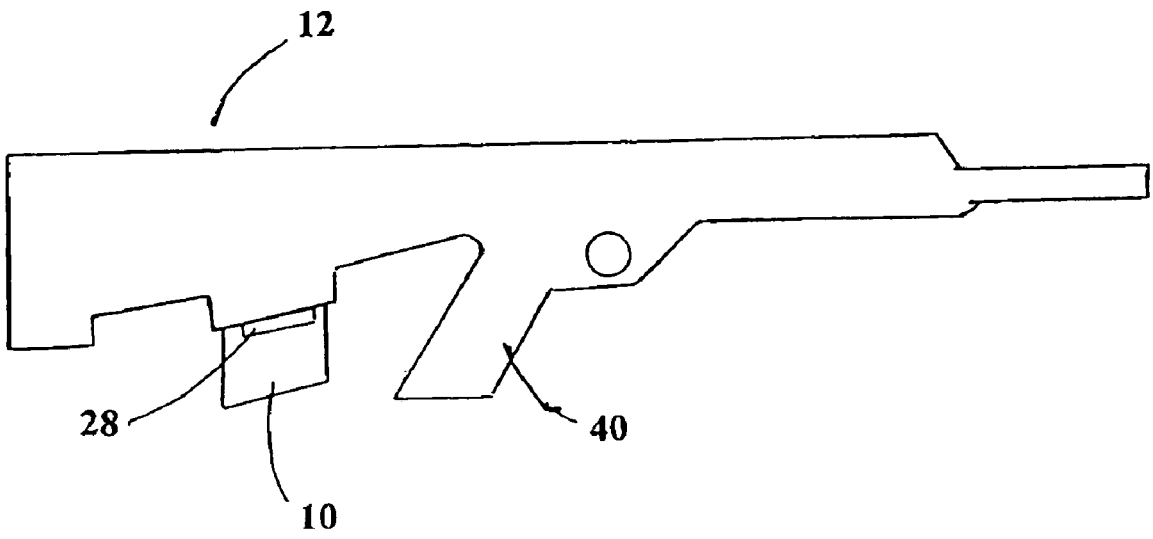
FIG. 6 is a front elevation view of a "bullpup"-type long gun with the magazine 10 inserted behind the trigger assembly 40, with the spring 28 butting up against the butt of the weapon 12.
Figure 7:
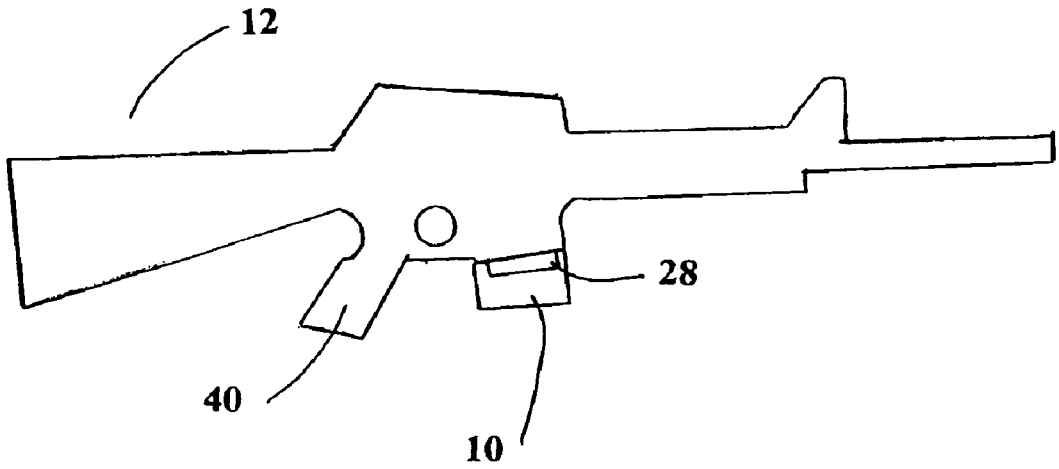
FIG. 7 is a front elevation view of a long gun with the magazine 10 inserted in front of trigger assembly 40, with the spring 28 butting up against the forearm of the weapon 12.

As illustrated in FIGS. 6 and 7, it is not required that the spring 28 always be disposed at the lower end of a magazine. In some long gun configurations (as well as in some pistols), the magazine protrudes quite a distance from the lower end of the magazine bay. In these types of firearms, such as the military-style "bullpup" carbine of FIG. 6 and the standard M16-style carbine shown in FIG. 7, the spring 28 is affixed to the outer wall of the housing of the magazine at a point adjacent to where the magazine protrudes from the firearm. Thus, for example, FIG. 6 illustrates a "bullpup"-type weapon 12, wherein the magazine bay is situated behind the trigger assembly 40. In this type of weapon, the spring 28 is affixed to the outer wall of the magazine housing. Thus, when the magazine 10 is inserted into the weapon, the spring 28 abuts the weapon at the butt end.

Similarly, FIG. 7 illustrates an M-16-style carbine 12. Here, when the magazine 10 is inserted into the weapon, the spring 28 abuts the weapon in the forearm portion of the weapon, in front of the trigger assembly 40.

Referring to FIG. 5, the magazine 10 feeds ammunition 26 into the weapon 12 via a feeder spring 24. The magazine 10 may be used with ammunition 26 of any size, type, caliber, or gauge, including ammunition that fires a single projectile (e.g. rifle bullets, foster-style slugs, sabot slugs, and the like) or multiple projectiles (e.g., shotgun shells). When the magazine 10 is out of ammunition 26, the empty magazine 10 is ejected from the weapon 12 by activating the magazine-release button (not shown) on the weapon 12. The magazine 10 is ejected from within the weapon 12, allowing a user to replace the empty magazine 10 with another fully-loaded magazine 10 without touching the magazine 10. Thus, when the magazine 10 is empty and the magazine release button on the weapon 12 is activated, the magazine 10 is forcefully ejected from the weapon 12, thereby dramatically increasing the speed of replacing the magazine 10.

The magazine 10 of the present invention can be constructed of metal, plastic, composite materials, or any other suitably stiff material. Metal is preferred, along with certain types of engineering plastics. A wide variety of engineering plastics can be employed if they have the appropriate strength, resilience, and toughness. Plastics such as polyesters, polyamides, and polyolefins such as polyethylene or polypropylene are potential candidates. The magazine 10 of the present invention can be also constructed from a thermoplastic composite of nylon, glass fibers and carbon black. An exemplary commercial material is a glass fiber-filled nylon sold by the Dupont Chemical Company under the trademark ZYTEL.

The spring 28 of the present invention can also be constructed of metal (preferably spring steel), plastic, composite materials, or any other material suitable for fabricating leaf springs. Preferably the spring is made of spring steel. The spring clip 28 may consist of a leaf spring, a coil spring or any other type of easily compressable spring. In the preferred embodiment, a leaf spring is used.

It is understood that the invention is not confined to the particular construction and arrangement of parts herein illustrated and described, but embraces such modified forms thereof as come within the scope of the following claims.

What is claimed is:

1. A quick-release magazine comprising: a magazine dimensioned and configured to releasably engage a firearm and feed ammunition to the firearm, a leaf-spring affixed to the magazine wherein the leaf spring contacts a handle of the firearm when the magazine is engaged with the firearm such that when the magazine is engaged with the firearm, the leaf spring is compressed against the firearm, thereby urging the magazine away from the firearm, and a floor plate and a slam pad, wherein the leaf spring is disposed between the floor plate and the slam pad.

2. The quick-release magazine of claim 1, wherein the magazine is dimensioned and configured to releasably engage a pistol.

3. The quick-release magazine of claim 1, wherein the magazine is dimensioned and configured to feed ammunition comprising a single projectile.

4. The quick-release magazine of claim 1, wherein the magazine is dimensioned and configured to feed ammunition comprising multiple projectiles.

5. The quick-release magazine of claim 1, wherein the leaf spring is affixed to the magazine at a point adjacent to where the magazine protrudes from the firearm.

6. The quick-release magazine of claim 1, wherein the leaf spring is releasably affixed to the magazine.

7. The quick-release magazine of claim 1, in further combination with a firearm.

* * * * *